US008281955B2

(12) United States Patent
Farnsworth et al.

(10) Patent No.: US 8,281,955 B2
(45) Date of Patent: Oct. 9, 2012

(54) PASSIVE DEVICE FOR STAGING AND DISPENSING OBJECTS

(75) Inventors: Bryan Patrick Farnsworth, Wake Forest, NC (US); Christopher Todd Hilliard, Bath, NC (US); Jason Cora, Raleigh, NC (US); Andrew Kirk Dummer, Chapel Hill, NC (US); David J. Parrish, Youngsville, NC (US); Dennis Vaders, Elkin, NC (US); Jennifer Ann Mauger, Durham, NC (US)

(73) Assignee: Parata Systems, LLC, Durham, NC (US)

( * ) Notice: Subject to any disclaimer, the term of this patent is extended or adjusted under 35 U.S.C. 154(b) by 0 days.

(21) Appl. No.: 13/300,965

(22) Filed: Nov. 21, 2011

(65) Prior Publication Data

US 2012/0061417 A1 Mar. 15, 2012

Related U.S. Application Data

(62) Division of application No. 12/185,981, filed on Aug. 5, 2008, now Pat. No. 8,061,560.

(60) Provisional application No. 60/955,059, filed on Aug. 10, 2007.

(51) Int. Cl.
*B65H 5/00* (2006.01)

(52) U.S. Cl. ..... 221/234; 221/247; 221/255; 221/260; 221/269

(58) Field of Classification Search ..... 221/269, 221/233, 234, 247, 255, 260, 239, 249
See application file for complete search history.

(56) References Cited

U.S. PATENT DOCUMENTS

| | | | | |
|---|---|---|---|---|
| 5,720,154 | A | 2/1998 | Lasher et al. | |
| 5,838,575 | A * | 11/1998 | Lion | 700/231 |
| 6,308,494 | B1 | 10/2001 | Yuyama et al. | |
| 6,385,943 | B2 * | 5/2002 | Yuyama et al. | 53/131.4 |
| 6,595,384 | B2 * | 7/2003 | Takahashi | 221/7 |
| 7,066,351 | B2 | 6/2006 | Chang | |
| 7,289,879 | B2 | 10/2007 | William et al. | |
| RE40,453 | E * | 8/2008 | Lasher et al. | 53/411 |
| 7,555,362 | B2 * | 6/2009 | Broussard et al. | 700/244 |
| 8,172,112 | B2 * | 5/2012 | Karwacki, Jr. | 222/181.1 |

* cited by examiner

*Primary Examiner* — Timothy Waggoner
(74) *Attorney, Agent, or Firm* — Myers Bigel Sibley & Sajovec

(57) ABSTRACT

A passive chute assembly includes: a chute configured to receive objects to be dispensed, the chute having an outlet; and a passive dispensing unit attached to the chute outlet. The passive dispensing unit has a staging portion, wherein objects are captured prior to dispensing. The staging portion is movable between a staging position, in which objects may be captured within the staging portion, and a dispensing position, in which the objects may be fed gravimetrically into a receptacle positioned below the dispensing unit. The staging portion includes an adaptive opening that, when the staging portion moves to the dispensing position, opens adaptively corresponding to a diameter of the receptacle.

12 Claims, 21 Drawing Sheets

PASSIVE DEVICE FOR STAGING AND DISPENSING OBJECTS

RELATED APPLICATION

The present application is a divisional application of and claims priority to U.S. patent application Ser. No. 12/185,981, filed Aug. 5, 2008 now U.S. Pat. No. 8,061,560 which claims priority from the U.S. Provisional Patent Application No. 60/955,059, filed Aug. 10, 2007 and entitled Passive Device for Staging and Dispensing Tablets Useful in System and Method for Dispensing Prescriptions, the disclosures of which are hereby incorporated herein by reference in their entirety.

FIELD OF THE INVENTION

The present invention is directed generally to the dispensing of prescriptions of pharmaceuticals, and more specifically is directed to the automated dispensing of pharmaceuticals.

BACKGROUND OF THE INVENTION

Pharmacy generally began with the compounding of medicines which entailed the actual mixing and preparing of medications. Heretofore, pharmacy has been, to a great extent, a profession of dispensing, that is, the pouring, counting, and labeling of a prescription, and subsequently transferring the dispensed medication to the patient. Because of the repetitiveness of many of the pharmacist's tasks, automation of these tasks has been desirable.

Some attempts have been made to automate all or portions of the pharmacy environment. Different exemplary approaches are shown in U.S. Pat. Nos. 6,006,946; 6,036,812 and 6,176,392 to Williams et al. and in U.S. Pat. No. 7,014,063 to Shows et al. The Williams system conveys a bin with tablets to a counter and a vial to the counter. The counter dispenses tablets to the vial. Once the tablets have been dispensed, the system returns the bin to its original location and conveys the vial to an output device. Tablets may be counted and dispensed with any number of counting devices. Shows et al. discloses a system that includes multiple drawers, each of which includes a plurality of dispensing devices that dispense tablets into a dispensing chute. The dispensing devices may be of the so-called "Baker Cell" configuration (see U.S. Pat. No. 3,368,713 to Hurst et al.), in which the tablets are mechanically singulated and counted prior to dispensing into the dispensing chute. The tablets are stored in the dispensing chute until such time as a pharmacist or technician dispenses the tablets from the chute into a pharmaceutical vial.

Although either of these particular systems can provide some automated steps to pharmaceutical dispensing, certain of the operations may be improved. In particular, tablets stored in the chute can jam, thereby rendering their dispensing in a waiting vial more difficult. Also, in some cases a pharmacy may desire some restrictions on the dispensing of the tablets from the chute.

SUMMARY OF THE INVENTION

As a first aspect, embodiments of the present invention are directed to a passive dispensing chute assembly. The assembly comprises: a chute configured to receive objects to be dispensed, the chute having an outlet; a plurality of staging members, each of the staging members being suspended from and pivotally interconnected with the chute, the staging members being coupled to move together between a staging position, in which lower ends of the staging members are drawn together to form an impassable cone, and a dispensing position, in which the lower ends of the staging members radially withdraw from each other to permit passage of objects therethrough; and a plurality of contact members, each of the contact members having an upper end that is suspended from and pivotally interconnected with a respective lower end of a staging member, wherein in the staging position, the upper ends of the contact members define a circle having a first circumference, and in the dispensing position, the upper ends of the contact members define a circle having a second circumference that is greater than the first circumference. Contact from underneath (for example, with a pharmaceutical vial) forces the contact members to move from the staging position toward the dispensing position.

As a second aspect, embodiments of the present invention are directed to a passive dispensing chute assembly, comprising: a chute configured to receive objects to be dispensed, the chute having an outlet; and a passive dispensing unit attached to the chute outlet. The passive dispensing unit has a staging portion, wherein objects are captured prior to dispensing. The staging portion includes a gate member movable between a staging position, in which objects may be captured within the staging portion, and a dispensing position, in which the objects may be fed gravimetrically into a receptacle positioned below the dispensing unit. The dispensing unit further includes a release member, the release member being coupled with the gate member, such that movement of the release member from a staging position to a dispenisng position moves the gate member from its staging position to its release position.

As a third aspect, embodiments of the present invention are directed to a passive chute assembly, comprising: a chute configured to receive objects to be dispensed, the chute having an outlet; and a passive dispensing unit attached to the chute outlet. The passive dispensing unit has a staging portion, wherein objects are captured prior to dispensing. The staging portion is movable between a staging position, in which objects may be captured within the staging portion, and a dispensing position, in which the objects may be fed gravimetrically into a receptacle positioned below the dispensing unit. The staging portion includes an adaptive opening that, when the staging portion moves to the dispensing position, opens adaptively corresponding to a diameter of the receptacle.

DETAILED DESCRIPTION OF EMBODIMENTS OF THE INVENTION

Figure 1:
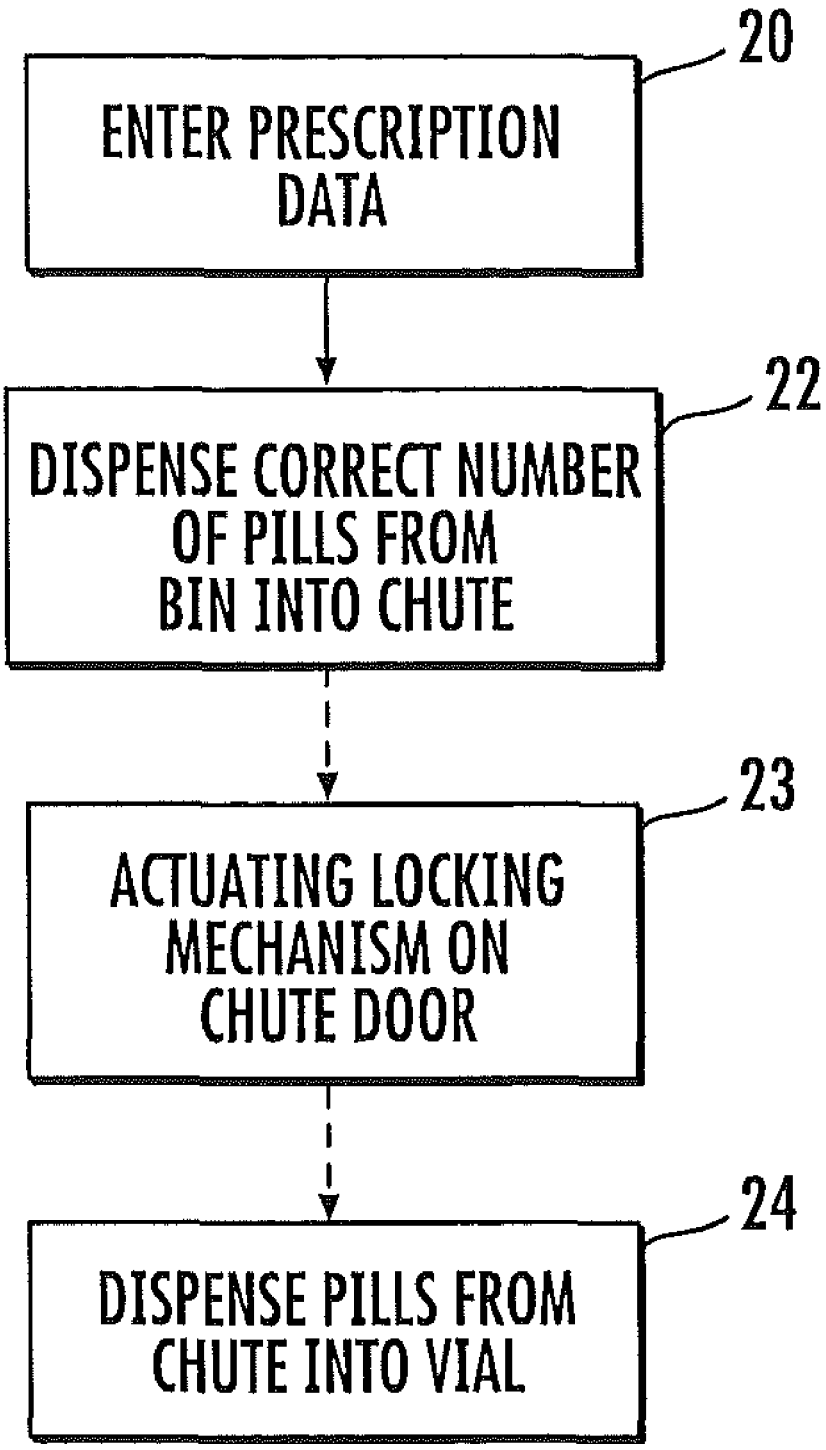
FIG. 1 is a flowchart illustrating operations of a pharmaceutical dispensing system according to embodiments of the present invention.

The present invention will now be described more fully hereinafter, in which preferred embodiments of the invention are shown. This invention may, however, be embodied in different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout. Thicknesses and dimensions of some components may be exaggerated for clarity.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein the expression "and/or" includes any and all combinations of one or more of the associated listed items.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Well-known functions or constructions may not be described in detail for brevity and/or clarity.

As described above, the invention relates generally to a system and process for dispensing pharmaceuticals. An exemplary process is described generally with reference to FIG. 1. The process begins with the entry of prescription data (Box 20). The correct number of pills to fill the prescription is dispensed from a bin containing a bulk supply of those pills into an attached chute (Box 22). The pills are then dispensed from the chute into a vial (Box 24), wherein the vial is typically held by pharmacy personnel. Optionally, the process may include a step in which a door of the chute is unlocked, typically in response to the system providing authorization to a user to release the pills from the chute (Box 23).

Figure 3:
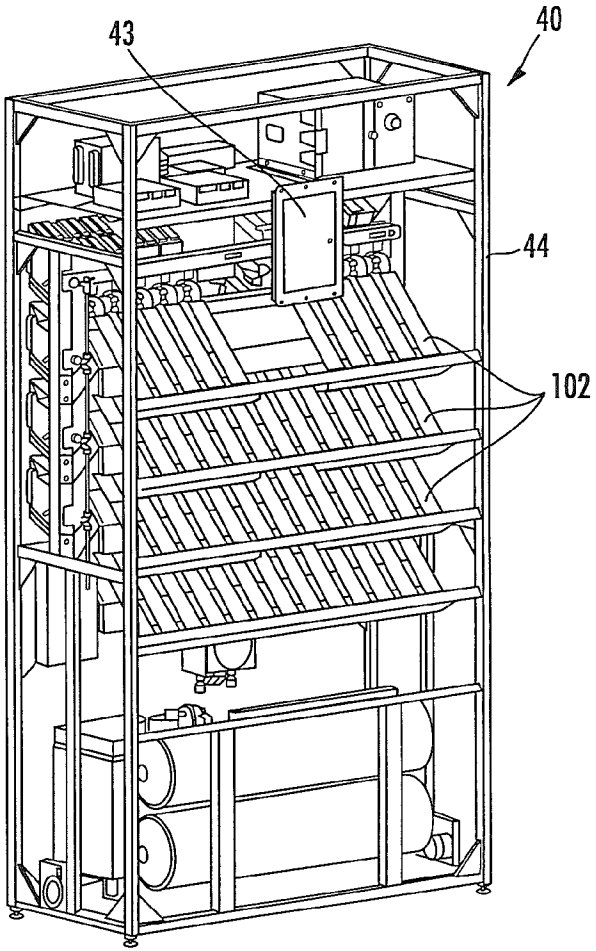
FIG. 3 is a reverse perspective view of the dispensing side (illustrating the chutes) of the pharmaceuticals dispensing system of FIG. 2.
Figure 2:
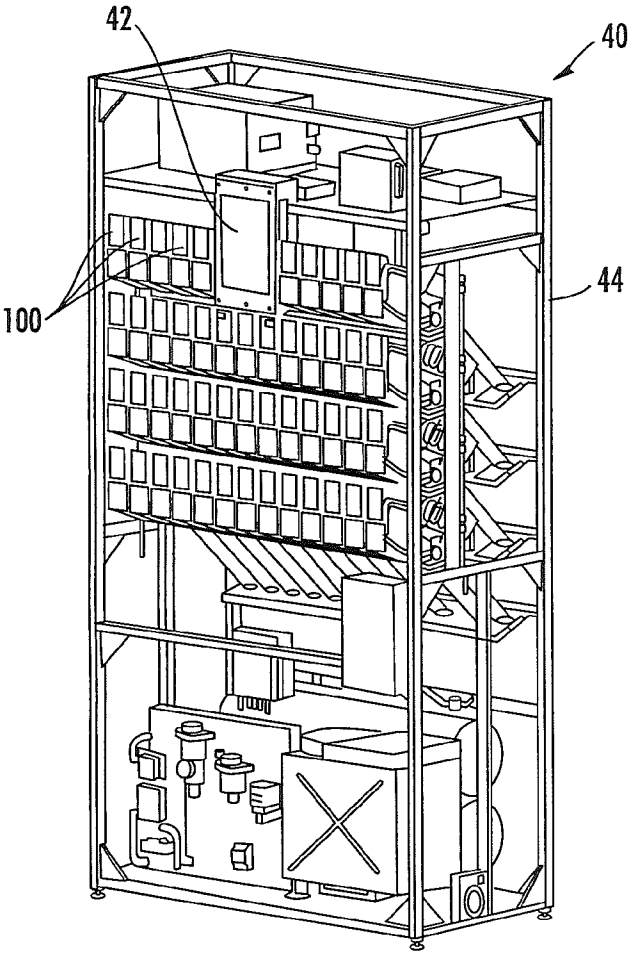
FIG. 2 is a perspective view of the replenishing side (illustrating the bins) of a pharmaceutical dispensing system according to embodiments of the present invention.

A system that can carry out this process is illustrated in FIGS. 2 and 3 and designated broadly therein at 40. The system 40 includes a support frame 44 for the mounting of its various components. The system 40 generally includes as operative stations a controller (represented herein by two graphics user interface monitors 42, 43), a number of tablet dispensing bins 100, and a number of chute assemblies 102, each associated with a respective bin 100.

In the illustrated embodiment, the bins 100 are configured to singulate, count and dispense pills through an air agitation technique. The air agitation technique is described in some detail in, for example, U.S. Pat. No. 6,971,541 to Williams et al., supra, and U.S. Patent Publication No. 2006/0241807, and need not be described in detail herein. Those skilled in this art will appreciate that other pill dispensing apparatus, including those that rely on mechanical singulating action (see, e.g., U.S. Pat. No. 7,014,063), may also be employed.

Figure 4:
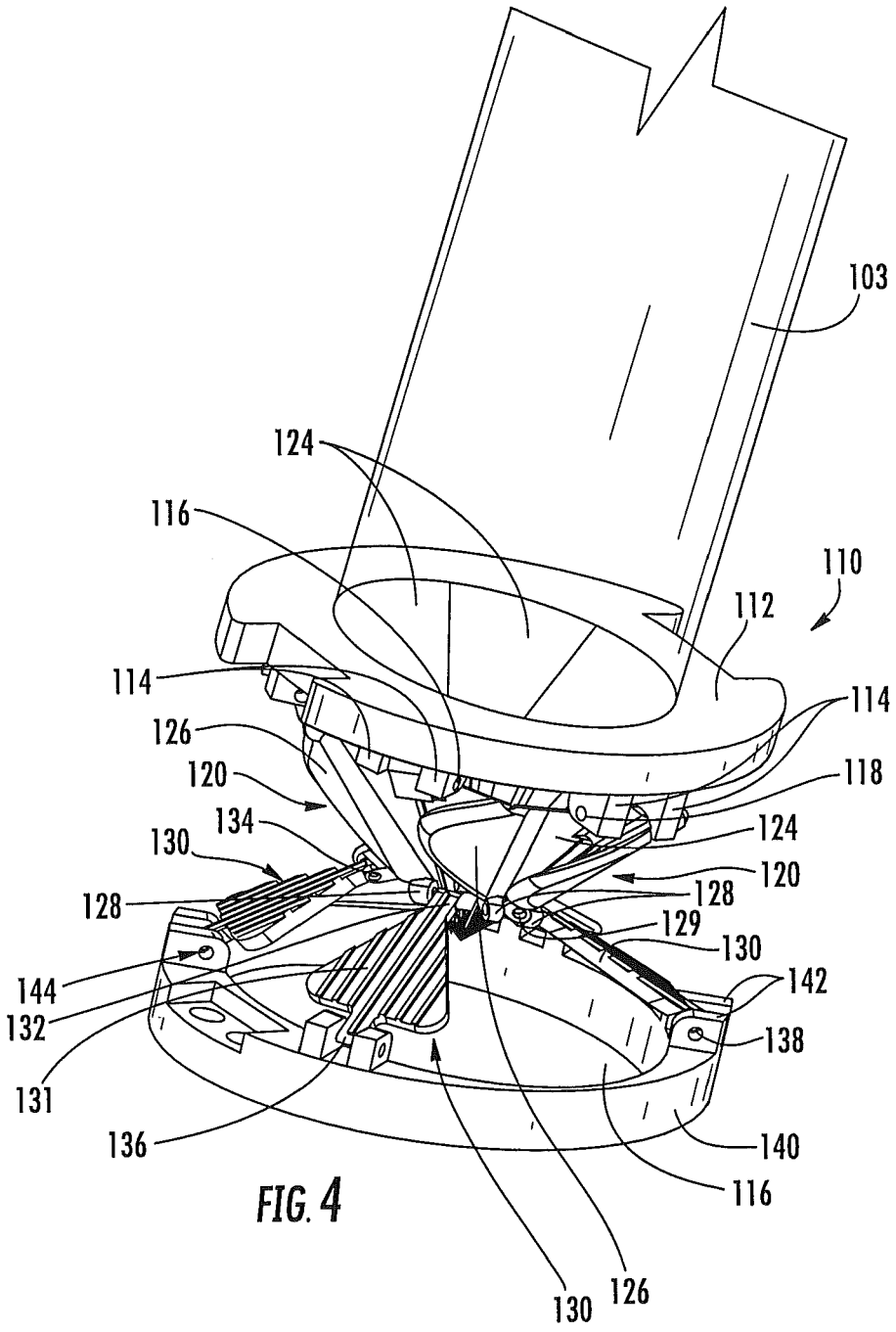
FIG. 4 is a perspective view of a dispensing stage assembly according to embodiments of the present invention, wherein the dispensing stage assembly is shown in its staging position.
Figure 5A:
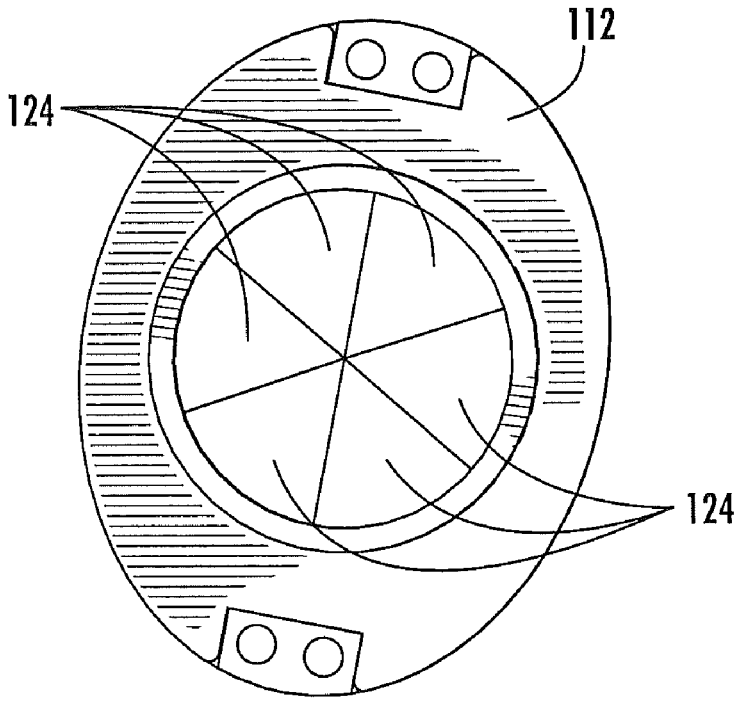
FIG. 5A is a top view of the dispensing stage assembly of FIG. 4.
Figure 5B:
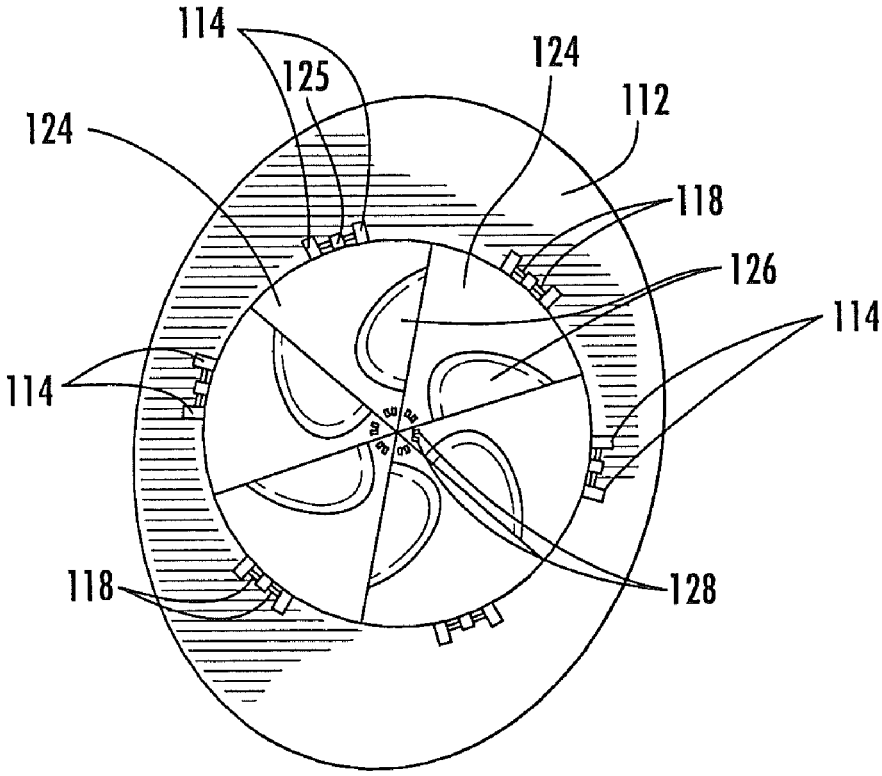
FIG. 5B is a bottom perspective view of the petals of the dispensing stage assembly, with the contact members and fixed ring omitted for clarity, the petals being shown in their staging position.
Figure 6:
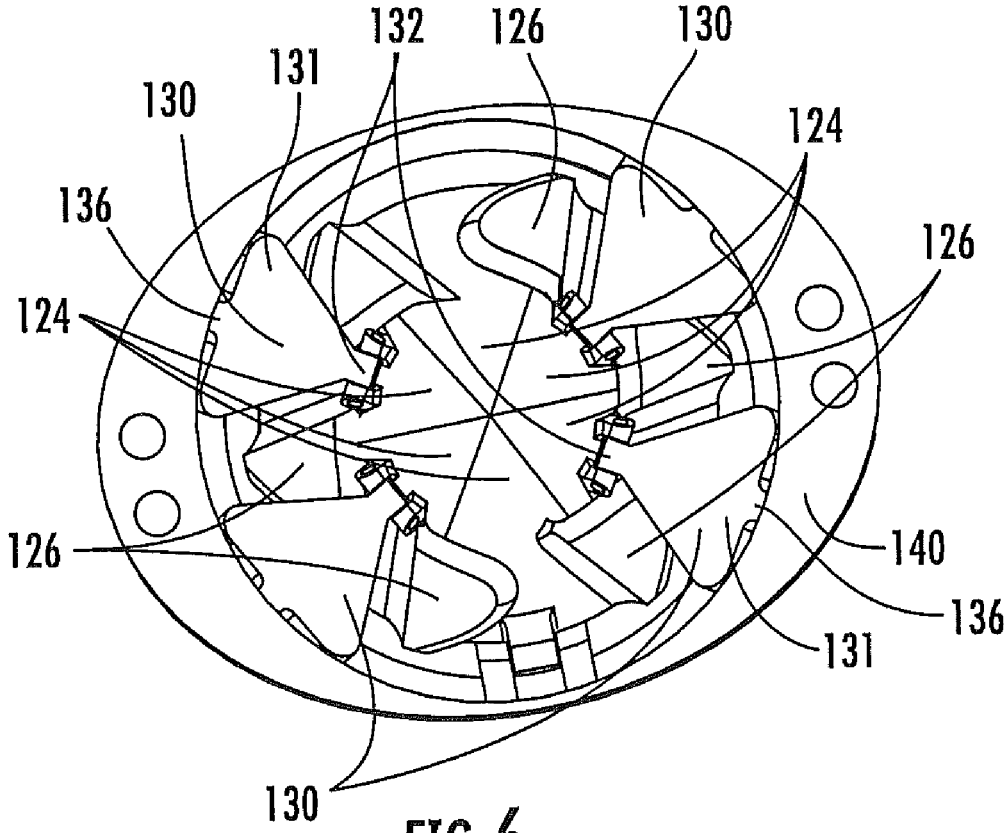
FIG. 6 is a bottom view of the dispensing stage assembly of FIG. 4.

Referring now to FIGS. 4-6, a dispensing stage 110 is located at the end of each chute 102. The dispensing stage 110 includes a floating base ring 112 that is fixed to a lower end 103 of the chute 102 (the lower end 103 being telescopically mounted on the upper end of the chute 102), a fixed ring 140 mounted to the frame 44, six petals 120, and four contact members 130 (only three contact members 130 are shown in FIG. 4 for clarity—four contact members 130 are shown in FIG. 6). The base ring 112 includes six pairs of depending flanges 114. Each flange 114 includes a generally horizontal aperture 116 that defines an axis of rotation.

Referring now to FIGS. 4, 5A and 5B, each petal 120 is pivotally attached to the base ring 112 at a respective pair of flanges 114 via a pin 118 that is inserted into the apertures 116. Each petal 120 includes a triangular panel 124. A tab 125 (see FIG. 5B) extends upwardly from the panel 124. The pin 118 is then inserted through a hole in the tab and into both of the apertures 116 in the flanges 114. Each petal 120 also includes an overleaf 126 of rounded triangular shape that extends from one edge of the panel 124. Also, a pair of flanges 128 extends downwardly and radially outwardly from the panel 124. Holes 129 are present in the flanges 128.

Referring now to FIGS. 4 and 6, each contact member 130 includes a body 131, a neck 132 that extends upwardly from one end of the body 131, and a tab 136 that extends downwardly from the opposite end of the body 131. Pins 134 extend outwardly from the neck 132 and are received in the holes 129 in the flanges 128 to pivotally attach the contact member 130 to a respective petal 120. Pins 138 also extend outwardly from the tab 136.

Referring again to FIGS. 4 and 6, the fixed ring 140 is mounted to the frame 44 and attached to the contact members 130. The floating ring 140 includes four pairs of upwardly extending flanges 142, each of which includes a hole 144. The pins 138 of the contact members 130 are inserted into the holes 144.

As can be seen in FIGS. 4-6, when the dispensing stage 110 is in its closed position, the triangular panels 124 of the petals 120 are oriented such that they are drawn together with their side edges in contact with one another, with the result that the panels 124 form a closed, impassable cone (as used herein, "impassable" means that the cone is impassable to solid objects of the size of drug tablets and the like, and does not require that the cone be, for example, airtight or watertight). In this position, the overleaf 126 of each petal 120 is positioned "behind" the panel 124 of the adjacent petal 120. The petals 120 are biased toward the closed position via gravity; the weight of the lower end 103 of the chute 102 and the base ring 112 is sufficient to maintain the petals 120 in the closed position. As a result, when pills are dispensed from a bin 100 into a chute 102, they are collected (i.e., "staged") in the cone formed by the panels 124, which serve as staging members. The pills remain staged in the dispensing stage 110 until they are released in the manner described below.

Figure 7:
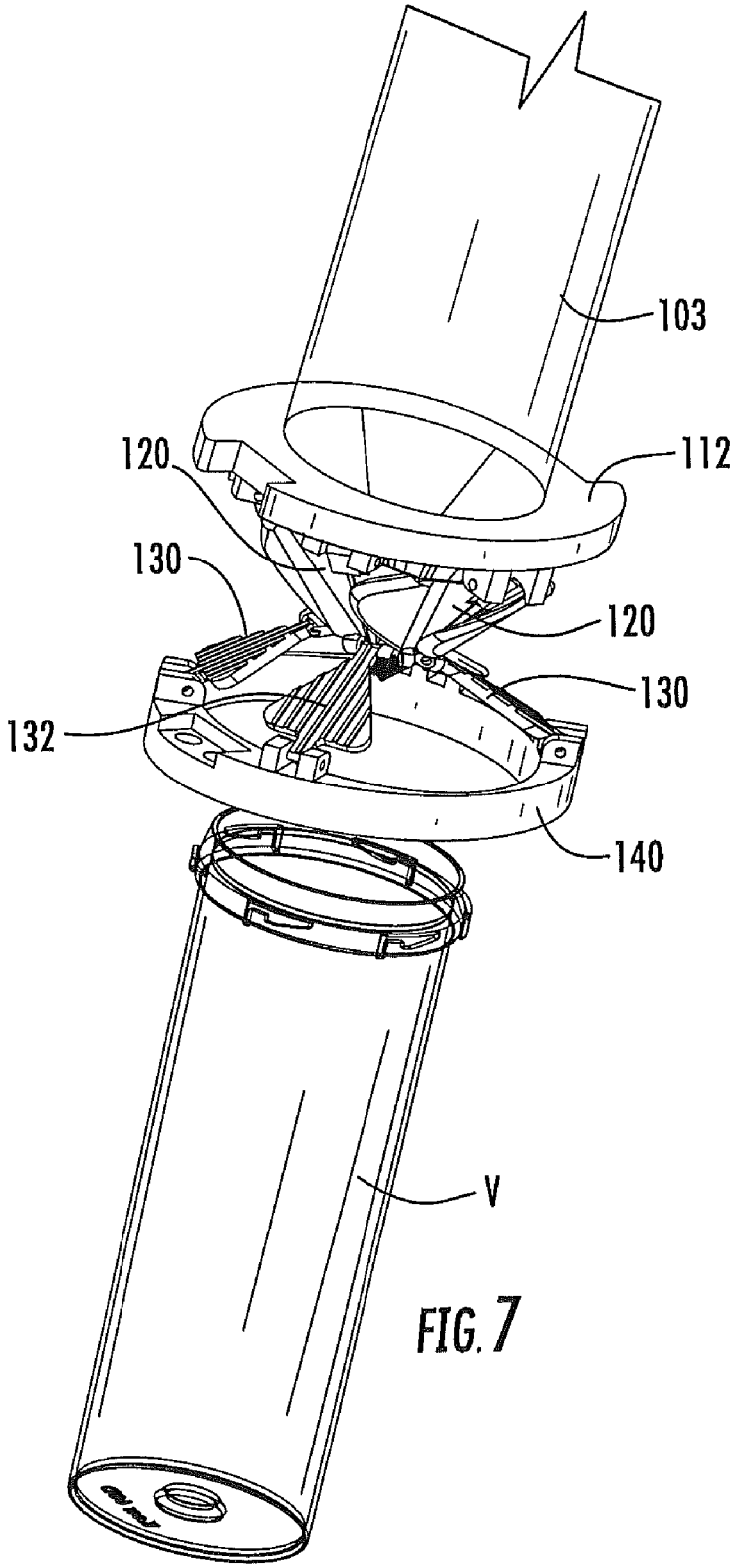
FIG. 7 is a perspective view of the dispensing stage assembly of FIG. 4 illustrating an approaching vial.
Figure 8:
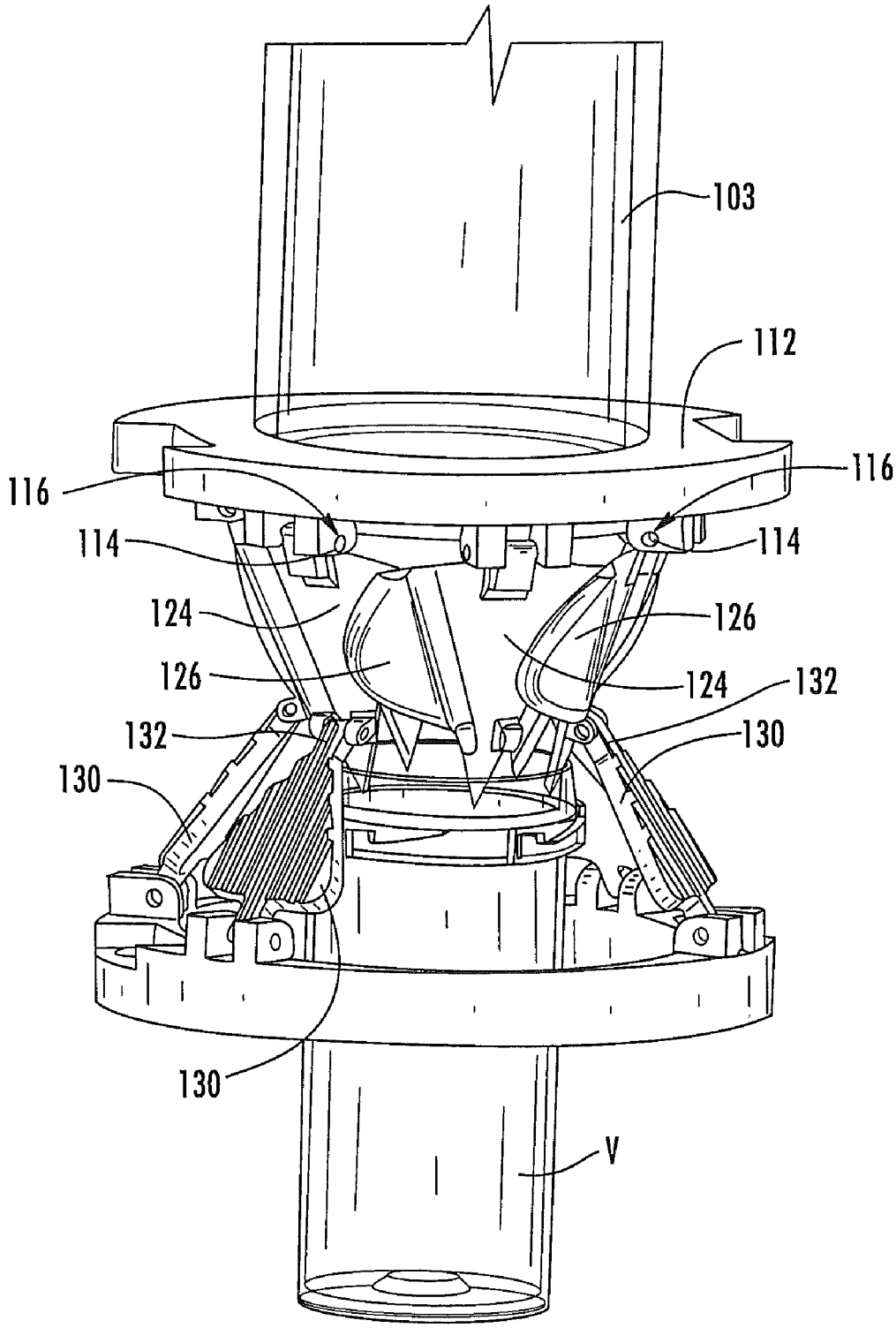
FIG. 8 is a side view of the dispensing stage assembly of FIG. 4 as the vial has moved the assembly to the dispensing position.

To release the pills from the dispensing stage 110, a vial V is lifted from underneath, open end up, until its rim contacts the underside of one of the contact members 130 (see FIGS. 7 and 8). Continued upward movement of the vial V overcomes the weight of the lower end 103 and the base ring 112 and causes each of the contact members 130 to pivot about the pins 138 such that its neck 132 separates radially from the other necks 132 (FIG. 8). In other words, a circle defined by the upper ends of the contact members is of larger circumference in the dispensing position than in the staging position. The rotation of the contact member 130 in turn causes its attached petal 120 to pivot about its pins 114 so that the pointed ends of the panel 124 withdraws radially from the other pointed ends. This movement forces the lower end 103 of the chute 102 upwardly, the lower end 103 telescopically collapsing on the upper end of the chute 102. In addition, the inclined orientation of the contact members 130 tends to naturally force the vial V toward the center of the fixed ring 140 directly below the pointed ends of the petals 120.

Figure 9:
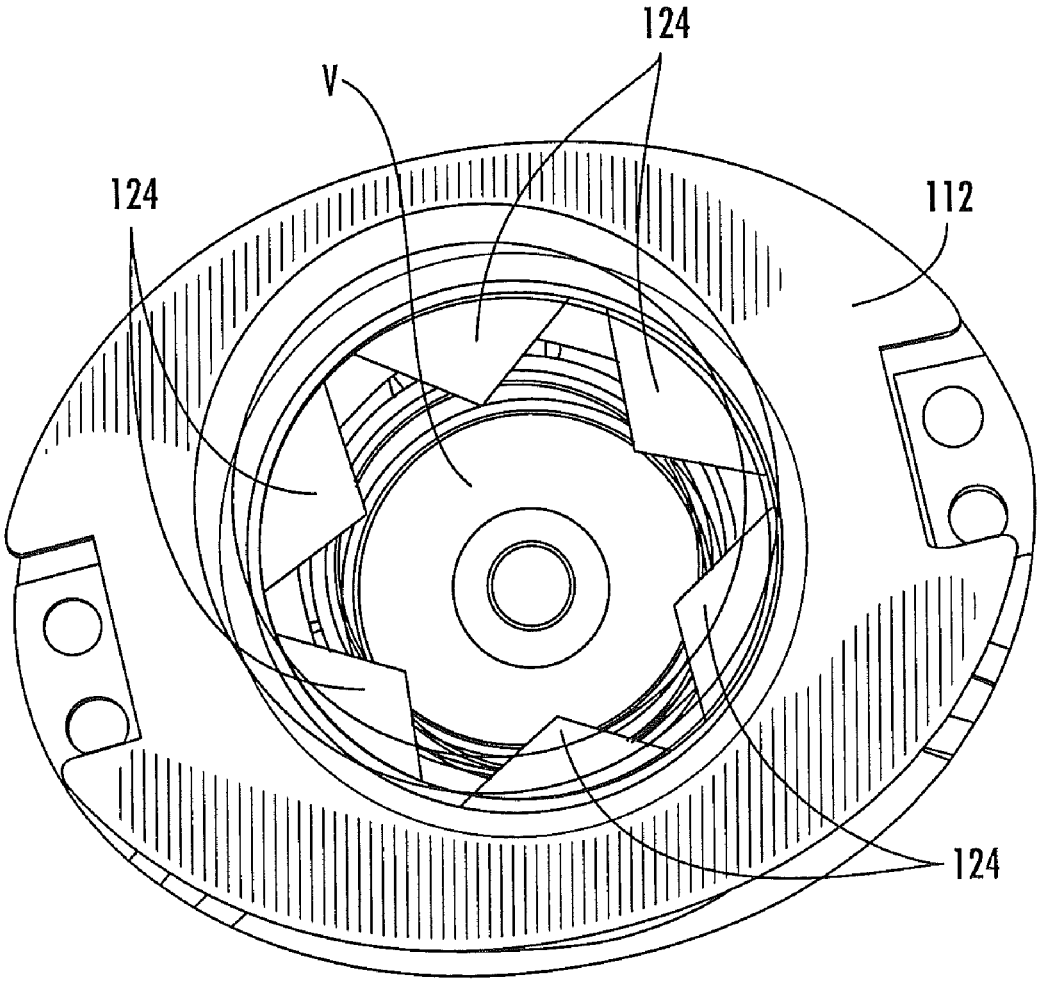
FIG. 9 is a top view of the dispensing stage assembly of FIG. 4 in the dispensing position.

Because an overleaf 126 underlies each petal 120, when any petal 120 begins to rotate to separate from the other petals 120, the panel 124 of that petal 120 contacts its underlying overleaf 126 and forces it radially outwardly. This movement in turn forces the adjacent petal 120 to which the underlying overleaf 126 is attached radially outwardly also. Thus, rotation of a single petal 120 causes all of the petals 120 to separate in concert. Consequently, as the vial V continues to rise, all of the petals 120 continue to separate radially. This separation stops when the vial V contacts the lower ends of the petals 120. At this point, the panels 124 form a "saw-tooth"-edged funnel that allows the pills staged in the chute 102 to slide into the vial V (see FIG. 9).

Once the pills have been dispensed into the vial V, the vial can simply be lowered from the fixed ring 140 and capped. The petals 120 and contact members 130 return, via gravity, to their closed positions of FIGS. 4-6.

Figure 10:
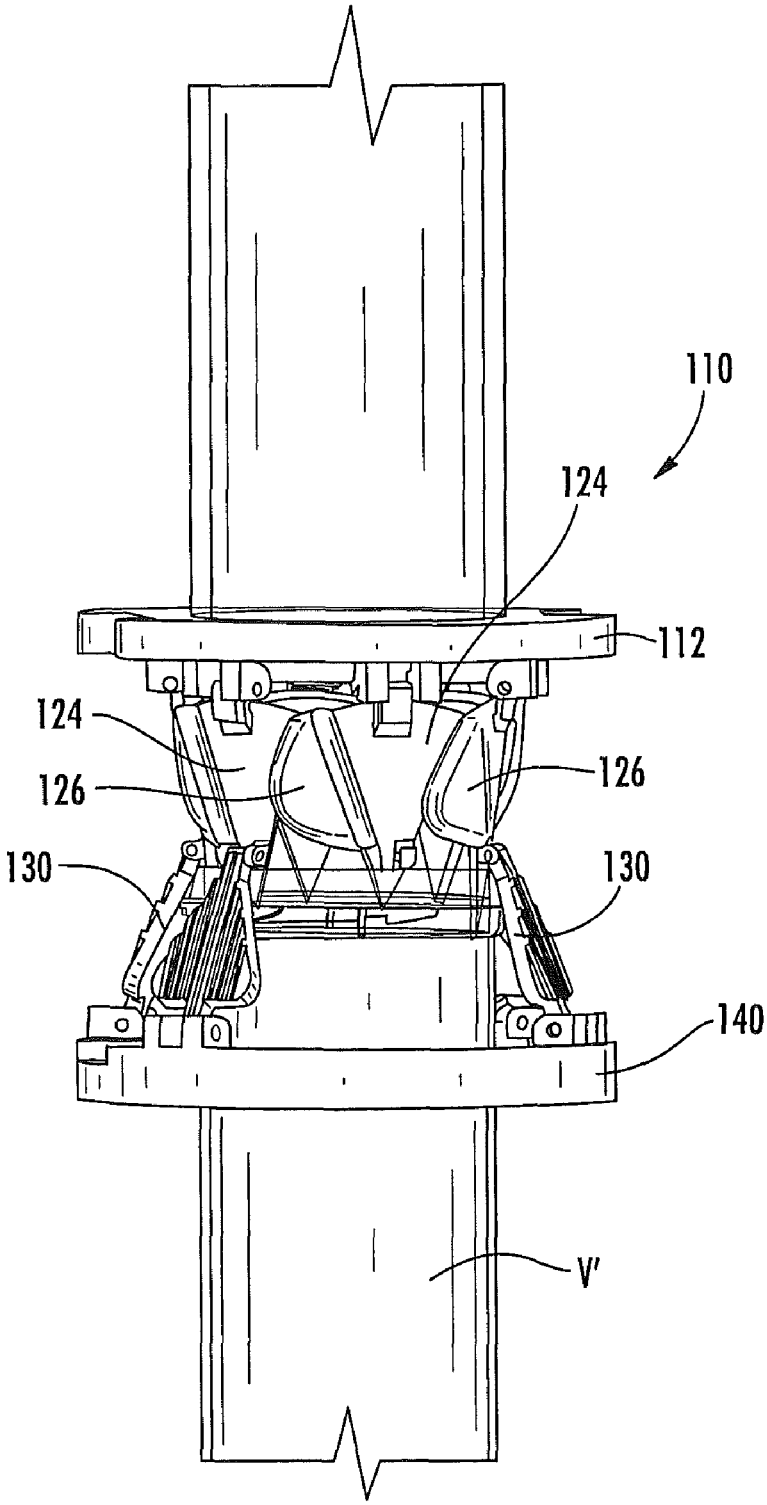
FIG. 10 is a side view of the dispensing stage assembly of FIG. 4 illustrating the use of a larger diameter vial.

Those skilled in this art will appreciate that a dispensing stage of this configuration may be used with vials of multiple diameters, i.e., the stage has an adaptive opening that open proportionately with the diameter of the receiving vial. For example, a larger vial V' is illustrated in FIG. 10 as it contacts the contact members 130. As can be seen in FIG. 10, the petals 120 can open wider for a larger diameter vial V', which may be appropriate for larger and/or greater numbers of tablets. Typically, vials will have diameters between about 1.1 and 1.9 inches.

In the configuration described above, the dispensing stage 110 can provide a method of dispensing staged pills in which the technician can dispense the pills with a single one-handed movement. Also, the dispensing stage 110 has the ability to adapt its dispensing opening to the size of the vial being filled, which can reduce the tendency of pills to jam or clog the opening while ensuring that no pills are spilled during dispensing. In addition, the lifting motion of the base ring 112 can provide potential energy to the pills to facilitate feeding. Moreover, the pills feed from the center of the "cone" first, followed by pills from the periphery of the cone; this sequential feeding scheme can reduce the tendency of the pills to jam.

Figure 17:
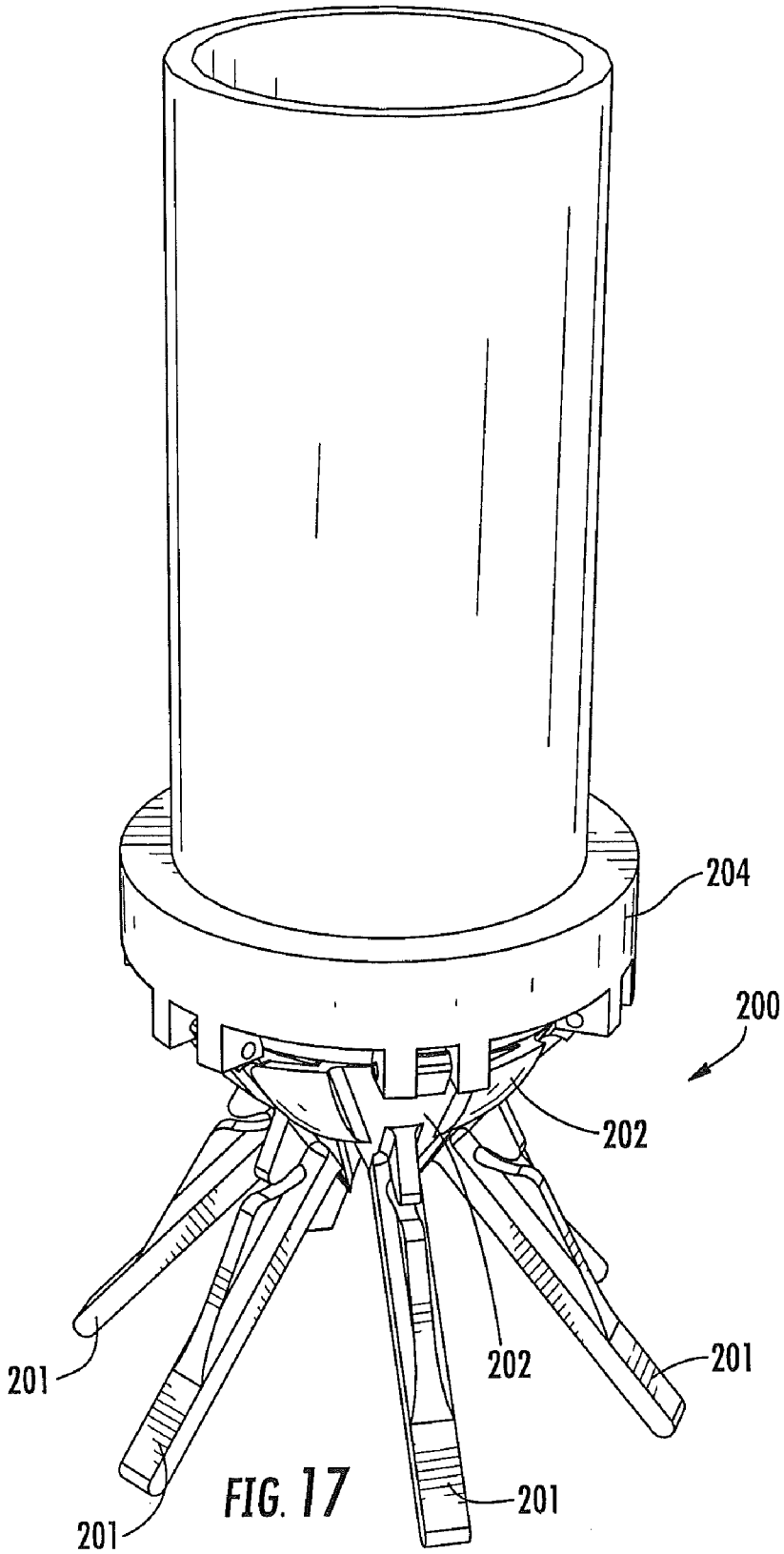
FIG. 17 is a perspective view of a dispensing stage assembly according to additional embodiments of the present invention.

Those skilled in this art will recognize that, as an alternative, the fixed ring 140 may "float," and the base ring 112 may be fixed. In one alternative embodiment, the upper base ring is fixed to the lower end of the chute (which does not telescope relative to the upper end of the chute), and the lower ring floats. In such embodiments, one or more of the petals 120, the contact members 130, the floating ring 140 or the base ring 112 may include a "stop" structure that prevents the floating ring 140 from simply rising when the vial is lifted. Exemplary structures include a stop post fixed to the base ring 112 that contacts the floating ring 140 when it is in the closed position, small stop nubs on the contact members that contact the petals, or the like. Also, in such embodiments one or more of the components may be spring-loaded to bias the petals 120 toward to the closed position. As another example, a dispensing stage 200 illustrated in FIG. 17 lacks a lower ring entirely, and has contact fingers 201 that are fixed to petals 202, which are in turn pivotally attached to a fixed ring 204. The petals 202 may be spring-loaded to be biased toward the closed position.

Those skilled in this art will appreciate that the dispensing stage may take other configurations also. For example, there may be fewer or more contact members and/or staging members. There may also be as many contact members as staging members in some embodiments. Other variations may also be apparent to those skilled in this art.

Another example of a passive dispensing stage is illustrated in FIGS. 11*a*-14 and designated broadly at 300. The dispensing stage 300 includes a base 302, a spout assembly 304, and a door 306. These components are described below.

Figure 11A:
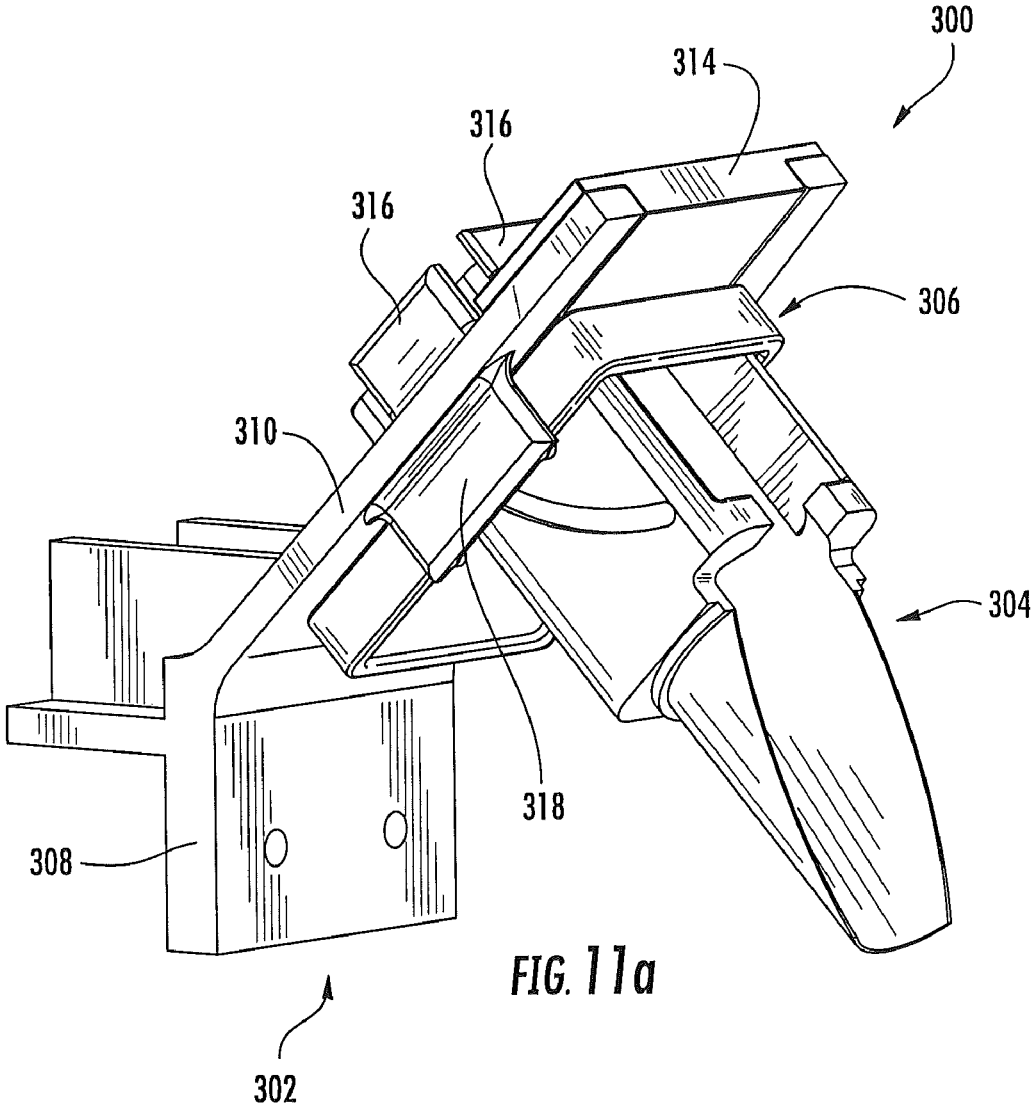
FIG. 11*a* is a perspective view of a dispensing stage assembly according to alternative embodiments of the present invention, with the door in its staging position.
Figure 12:
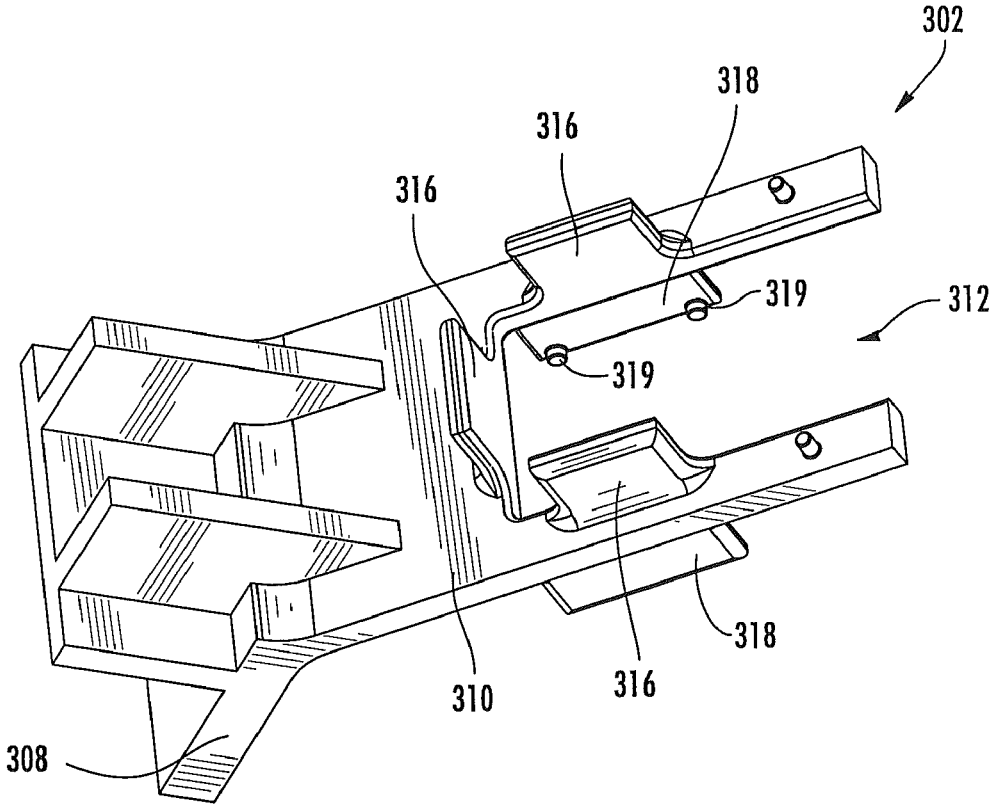
FIG. 12 is a perspective view of the base of the dispensing stage assembly of FIG. 11.

Referring to FIGS. 11*a* and 12, the base 302 is adapted to be mounted onto a frame such as the frame 44 above via a mounting flange 308. A door mounting portion 310 extends upwardly at approximately a 45 degree angle from the mounting flange 308 and includes a cutaway area 312, over which a member 314 is mounted. Four retaining tabs 316 (three on the base 302, and one on the member 314) extend upwardly about the periphery of the cutaway area 312, and two tabs 318 extend downwardly from opposite sides of the cutaway area 312. Support nubs 319 extend inwardly from the tabs 318.

Figure 13:
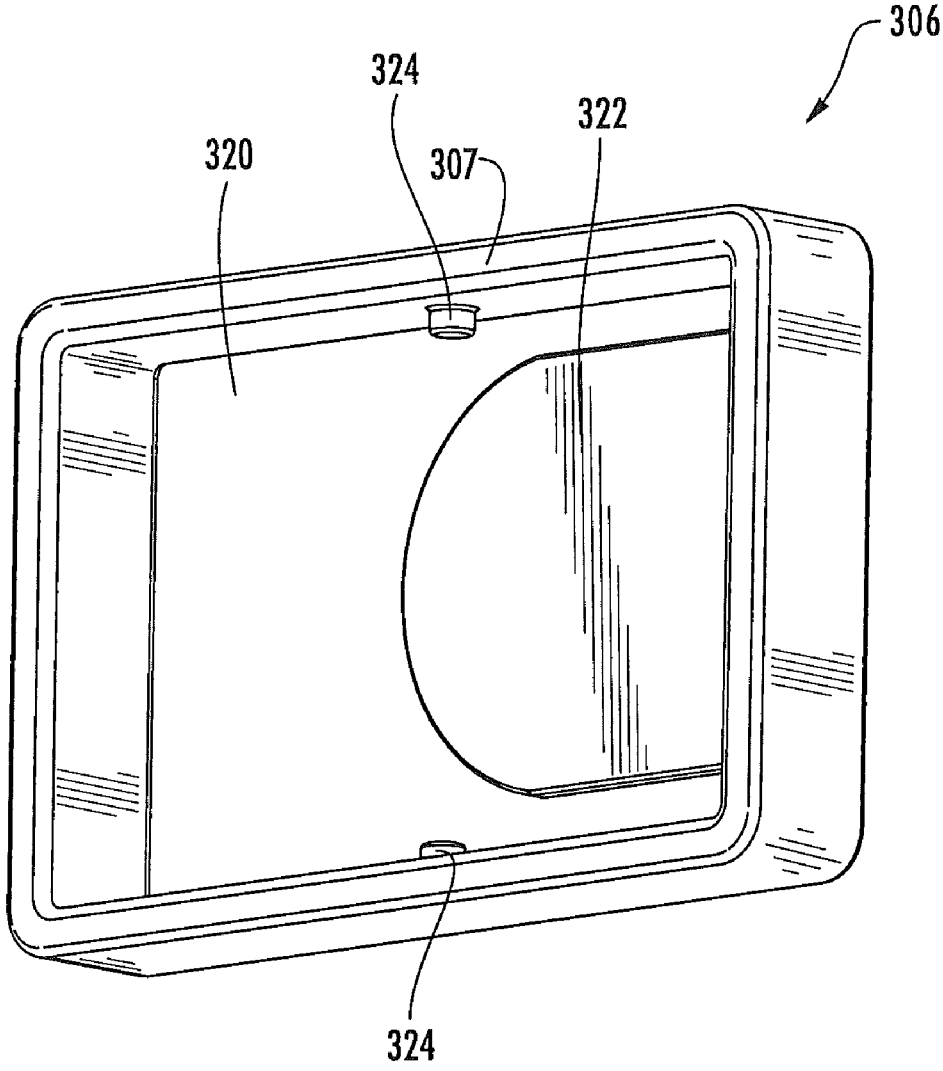
FIG. 13 is a top perspective view of the door of the dispensing stage assembly of FIG. 11.

Referring now to FIG. 13, the door 306 has a generally rectangular frame 307, with an open portion 320 and a rounded tongue 322 that extends rearwardly from one end of the frame 307. Two pegs 324 extend inwardly from opposite sides of the frame 307. The door 306 is positioned below the cutaway area 312 of the frame 307 and is supported from underneath by the support nubs 319, which enable the door 306 to slide relative to the base 302 parallel to the door mounting portion 310. Together the door 306 and the base 302 comprise the staging portion of the stage 300.

Figure 14:
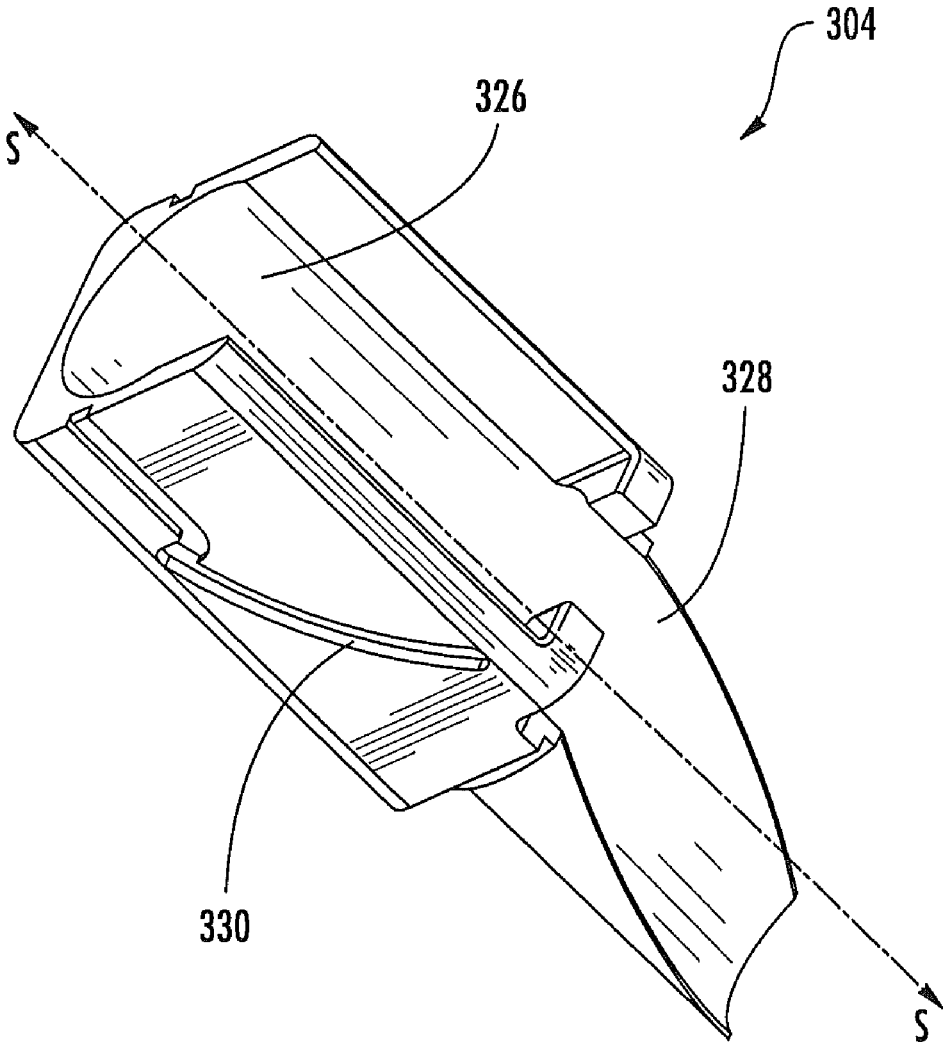
FIG. 14 is a perspective view of the spout assembly of the dispensing stage assembly of FIG. 11.

Referring now to FIG. 14, the spout assembly 304 includes a U-shaped base 326 that defines an axis S and a flexible spout 328. The base 326 extends into and perpendicular to the cutaway area 312 of the door mounting portion 310. Curved tracks 330 are recessed into the walls of the base 326 and receive the pegs 324 of the door 306. The upper end of the base 326 is adapted to attach to the lower end of a dispensing chute (not shown) similar to that illustrated in FIG. 3 above (with this embodiment, as with the embodiment of FIGS. 4-10, the lower end of the chute can move along the axis of the chute; this can be accomplished with, for example, a telescoping chute). The spout 328 is generally semicircular in cross-section and tapers toward its lower end; it is typically formed of a flexible material, such as a rubber or silicone compound.

In the staging position shown in FIG. 11*a*, the tongue 322 of the door 306 fits within the channel defined by the spout assembly base 326. The pegs 324 of the door 306 are positioned at the upper (rearward) end of the tracks 330. As such, the tongue 322 covers the portion of the cutaway area 312 that is directly below the chute 102. Thus, when pills are dispensed from a bin 100, they can be staged in the dispensing stage 300, as they are captured by the base 326 and the tongue 322.

Figure 11B:
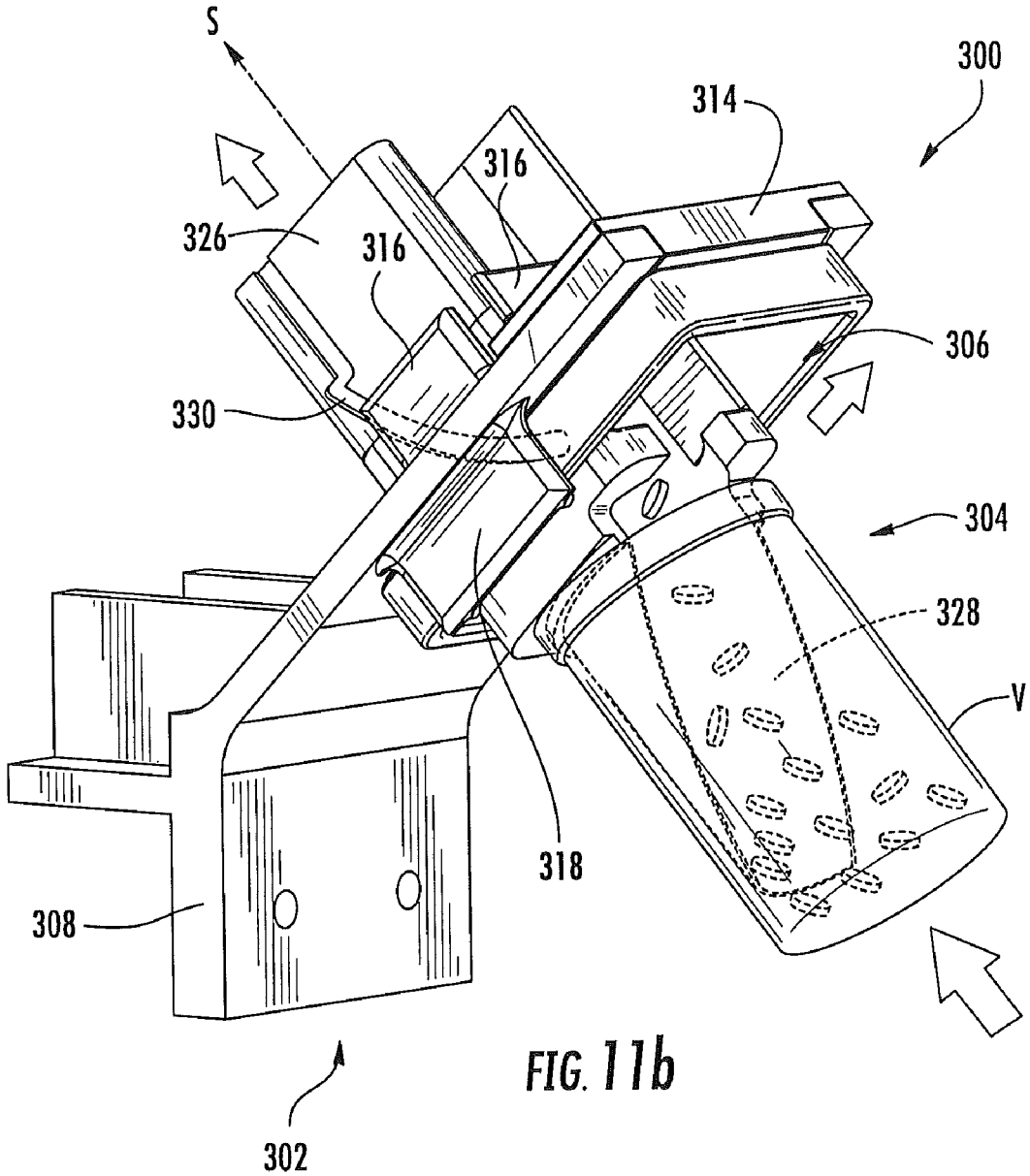
FIG. 11*b* is a perspective view of the dispensing stage of FIG. 11*a*, with the door shown in its dispensing position.

To release the pills, a technician can position a vial such that the lower end of the spout 328 fits within the interior of the vial V. The flexibility of the spout 328 enables the spout 328 to bend to fit within the vial V. The technician can then lift the vial V generally parallel to the axis S (FIG. 11*b*). Doing so raises the base 326 (and, in concert, the lower end of the chute) along the axis S. As the base 326 rises (with the vial V still encircling the spout 328), the interaction between the pegs 324 and the tracks 330 forces the door 306 to move upwardly and forwardly along a plane that is generally normal to the axis S. This movement removes the tongue 322 from the opening at the lower end of the dispensing chute, thereby permitting passage of pills staged in the dispensing stage 300 to feed into the vial V along a path parallel to the axis S and opposite the direction that the spout 328 translates. Thus, the spout assembly 304 serves as the release member of the stage 300.

In some embodiments, raising of the door 306 can cause pills that are resting on the tongue 322 to be "dragged" along with the door 306 due to friction between the pills and the tongue 322. This behavior can help to agitate the staged pills and improve flow into the vial V. Certain embodiments may include an agitation finger or the like projecting from the tongue 322 to assist with agitation.

The dispensing stage 300 returns to the staging position of FIG. 11*a* when the vial V is removed from the spout 328. Once the vial V is removed, gravity forces the door 306 downwardly and rearwardly until the pegs 324 reach the lower edges of the tracks 330.

Like the dispensing stage 110 described above, the dispensing stage 300 can also be operated with one hand, and can adapt to vials of different diameters.

Figure 15:
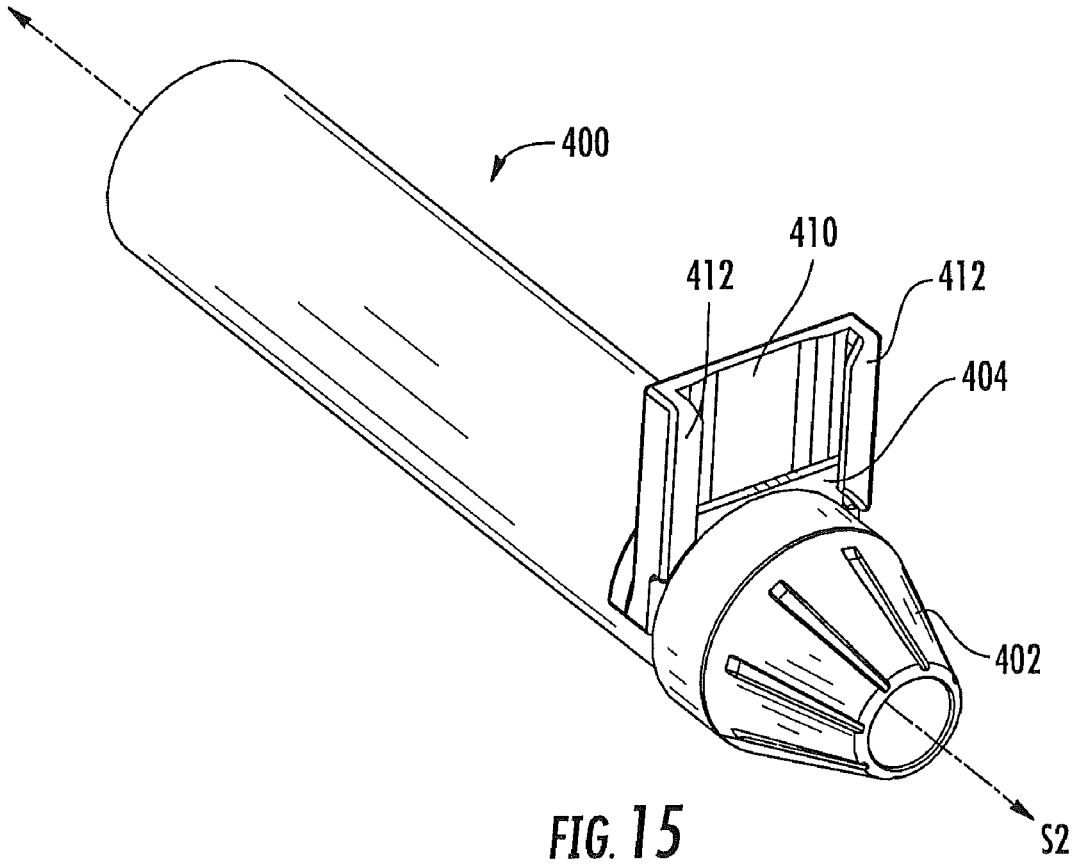
FIG. 15 is a perspective view of a dispensing stage assembly according to additional embodiments of the present invention, with the door in its staging position.
Figure 16:
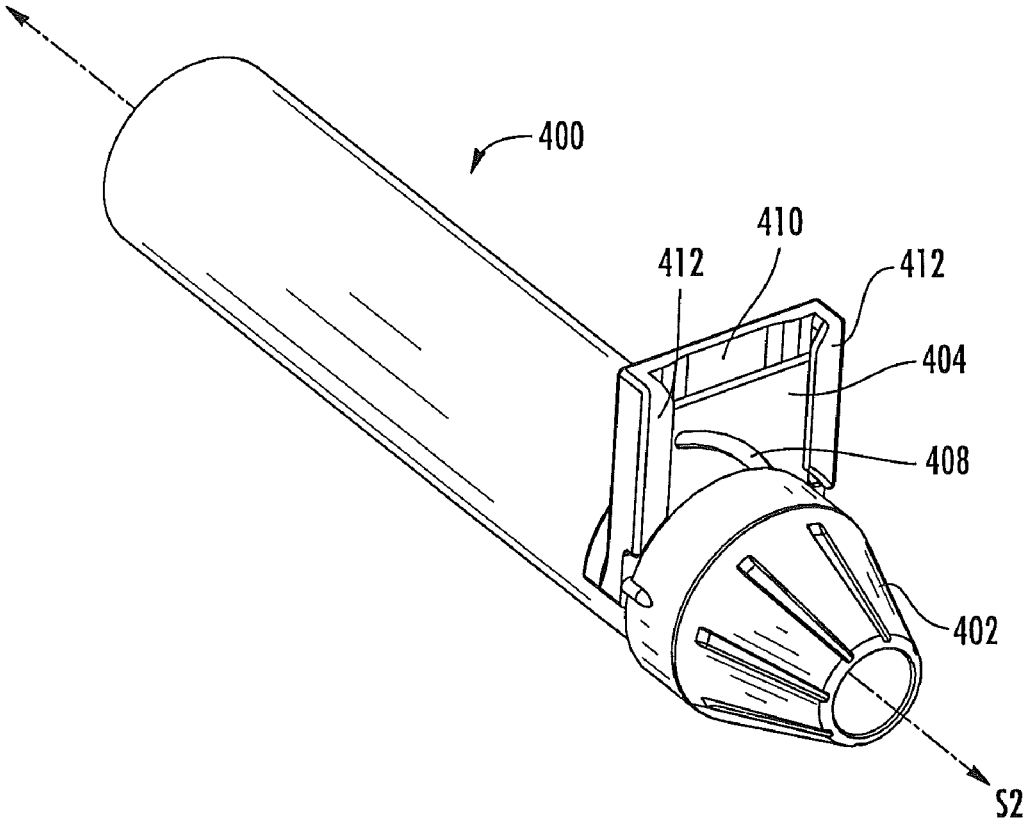
FIG. 16 is a perspective view of the dispensing stage assembly shown in FIG. 15, with the door in its dispensing position.

A variation of the dispensing stage 300 is illustrated in FIGS. 15 and 16 and is designated broadly at 400. The dispensing stage 400 includes a flexible spout 402 that rotates about, rather than translates along, about an axis S2 in order to open a door 404 to release staged pills. The spout 402 includes a pin (not shown) that fits within a slot 408 in the door. The door 404 is held in place by a mounting member 410 that includes lips 412 on its underside that allow the door 404 to slide relative thereto and is biased by gravity (or other biasing means) toward the staging position of FIG. 15. In the staging position, the door 404 covers the opening in the mounting member 410. Rotation of the spout 402 forces the door 404 away from the opening at the bottom of the chute 102 (FIG. 16) due to the interaction between the pin on the spout 402 and the slot 408. This embodiment also enables the technician to release staged pills with a one-handed motion, and the flexibility of the spout 402 can adapt to the size of the vial that is provided and, in doing so, can prevent pill jams; in this manner the flexible spout 402 enables the stage 400 to be used with vials of different sizes. In this embodiment, the lower end of the chute 102 can remain stationary.

Another variation of the dispensing stage 300 is shown in FIGS. 18-21 and is designated therein at 500. The dispensing stage 500 includes a flexible spout 504 that is mounted at one end to a gate holder 508. The gate holder 508 is generally U-shaped, the arms 508*a* of the "U" being spanned by a bridge 506. The gate holder 508 fits under the end of a chute 502 and is slidable relative thereto. Open-ended longitudinal slots 510 that extend generally parallel to the chute 502 are located on the upper ends of the arms 508*a*. Also, angled slots 512 are located in the arms 508*a* near the lower ends of the slots 510.

A generally U-shaped gate 520 is mounted onto the chute 502 via hinge pins 526 located on wings 522. Each of the hinge pins 526 extends through a respective open-ended slot 510 and is inserted into a mounting aperture 503 in the chute 502. As such, the hinge pins 526 define an axis of rotation R1. A slide pin 528 is located on each of the wings 522 and extends into a respective slot 512. A cover 524 extends downwardly between the wings 522 and, in the closed position of FIGS. 18 and 20, covers the lower opening of the chute 502.

Figure 18:
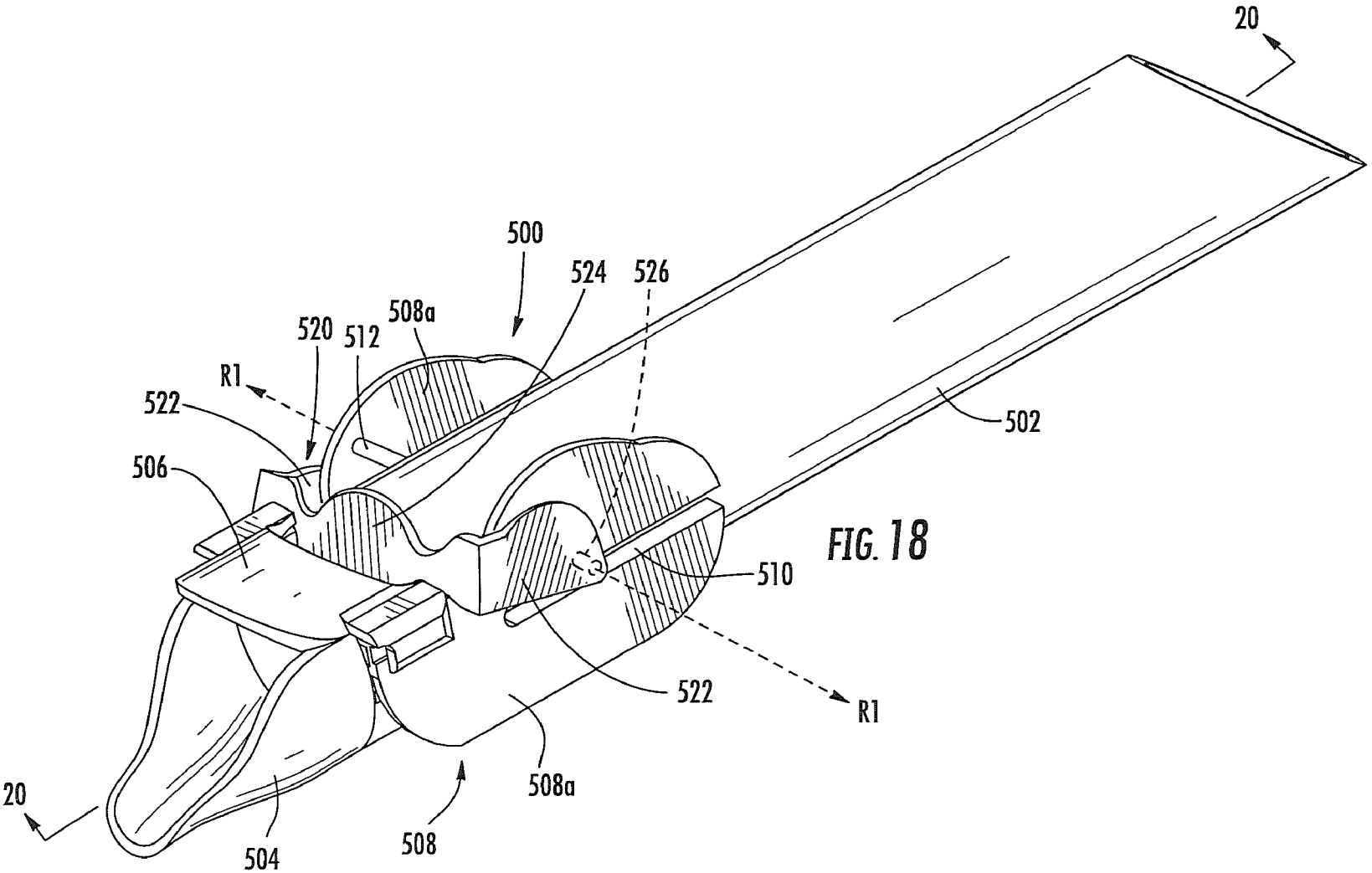
FIG. 18 is a perspective view of a dispensing stage assembly according to further embodiments of the present invention, with the gate in its closed position.
Figure 19:
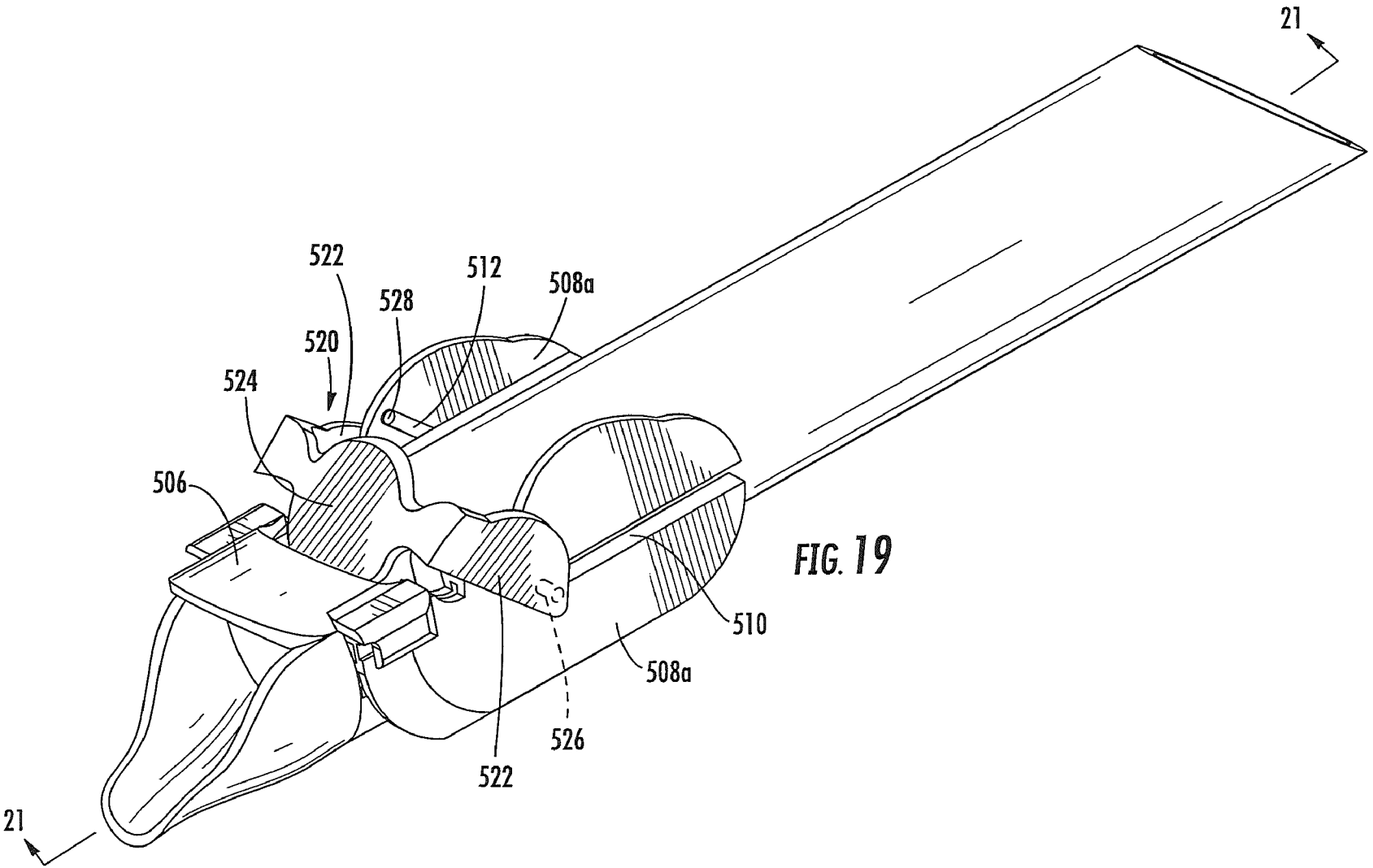
FIG. 19 is a perspective view of the dispensing stage assembly of FIG. 18, with the gate in its open position.
Figure 20:
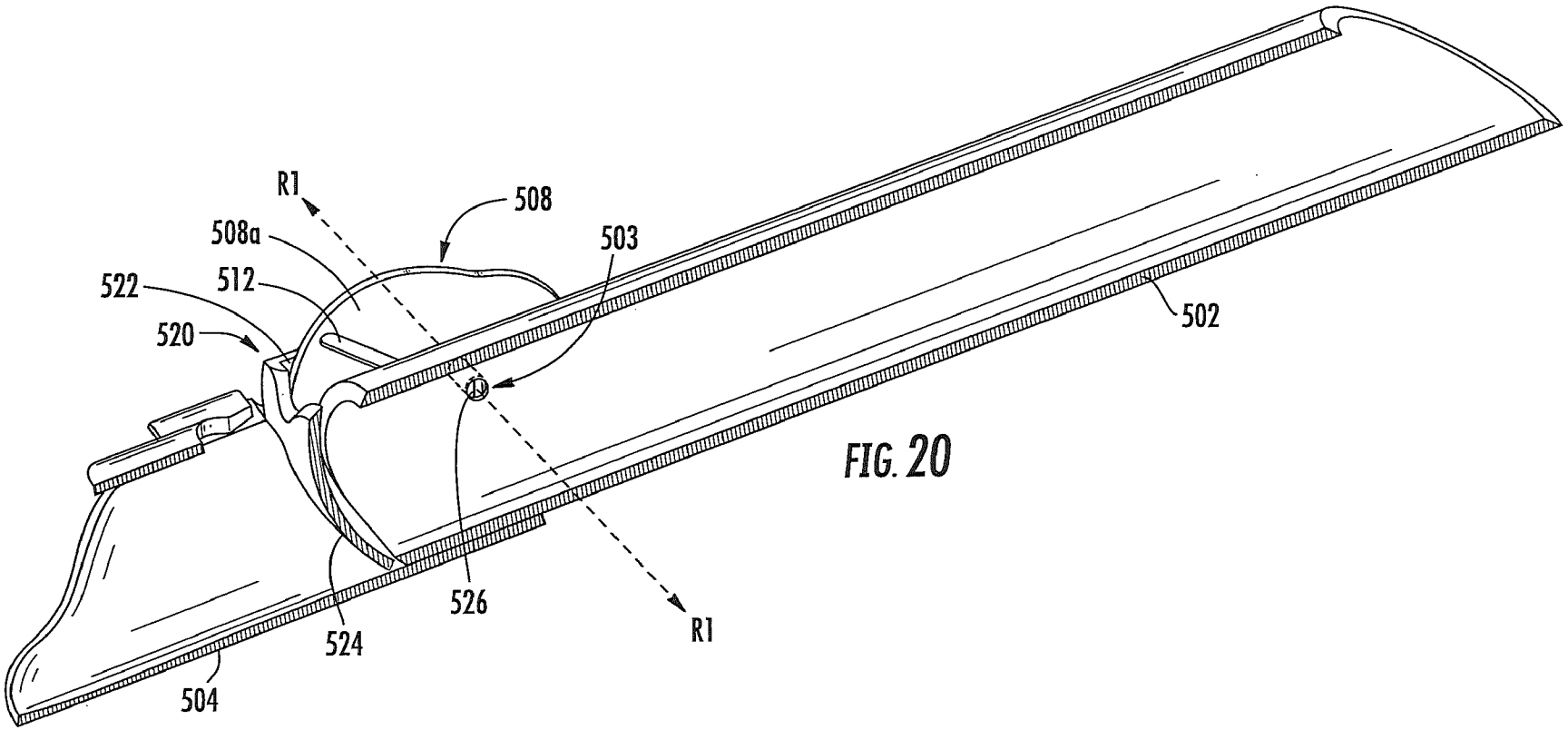
FIG. 20 is a section view of the dispensing stage assembly of FIGS. 18 and 19 taken along lines 20-20 of FIG. 18 shown in the closed position.
Figure 21:
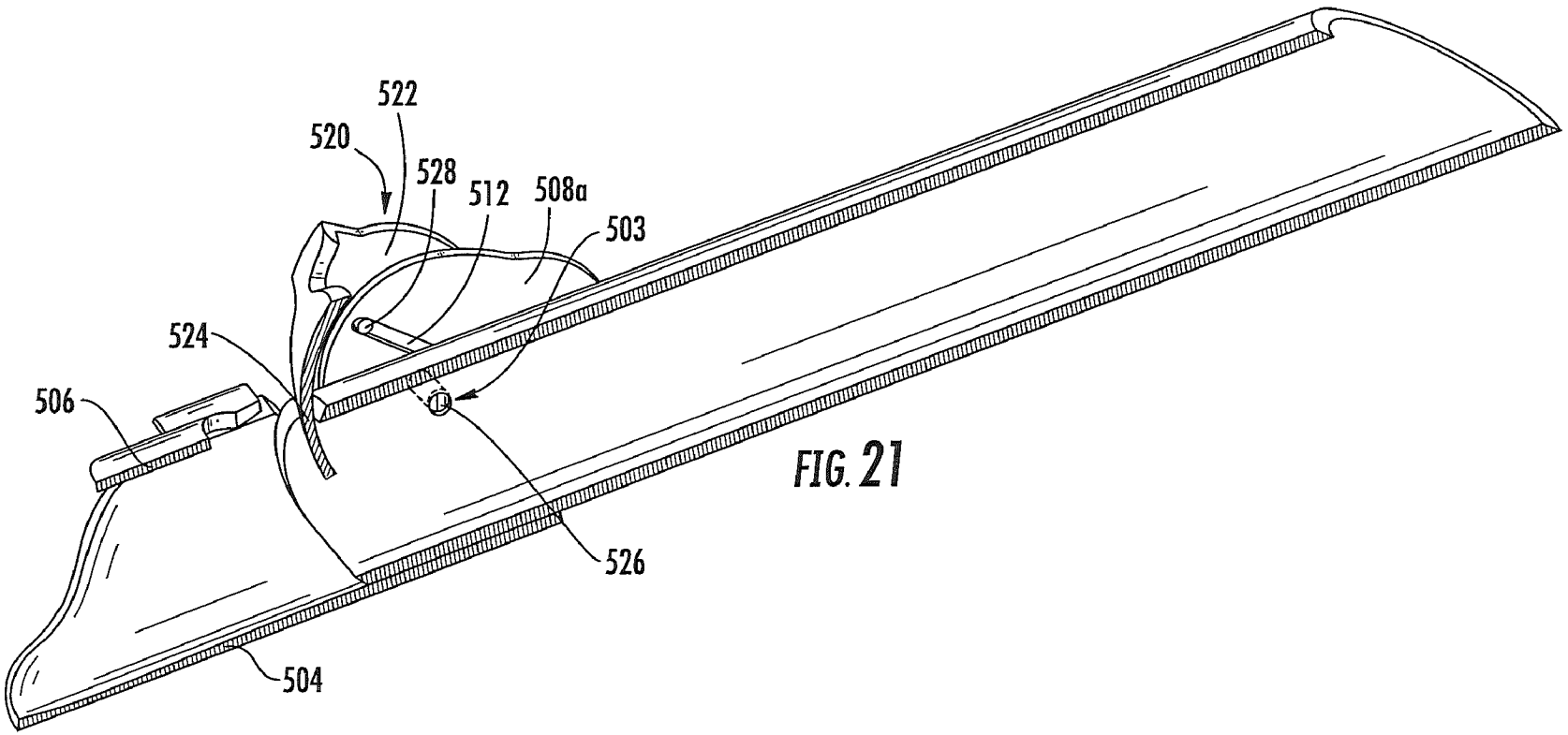
FIG. 21 is a section view of the dispensing stage assembly of FIGS. 18 and 19 taken along lines 21-21 of FIG. 19 shown in the open position.

It can be seen that, in the closed position of FIGS. 18 and 20, the gate 520 prevents the passage of pills that are dispensed into the chute 502. When an operator wishes to retrieve the dispensed pills from the chute 502, he can simply push an open vial against the lower end of the spout 504 (preferably inserting the vial over the spout 504 to minimize slippage), which action forces the spout 504 and the gate holder 508 upwardly (i.e., along the axis of the chute 502). As the gateholder 508 moves, interaction between the slide pins 528 of the gate 520 and the slots 512 of the gate holder 508 forces the gate 520 to rotate (clockwise in the direction shown in FIGS. 20 and 21) about the axis R1. This rotation moves the cover 524 away from the opening at the lower end of the chute 502, thereby allowing pills residing in the lower end of the chute 502 to drop into the vial (see FIGS. 19 and 21). Once all of the pills have descended into the vial, the vial is removed, at which point gravity draws the spout 504 and gateholder 508 downwardly and forces the gate 520 to return to the closed position of FIGS. 18 and 20.

Those skilled in this art will appreciate that the dispensing stages of the present invention may also be employed with the dispensing of objects other than pharmaceutical tablets. For example, small component parts in a manufacturing line, dispensable candies, and the like may be dispensed with the stages of the present invention.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A passive dispensing chute assembly, comprising:

a chute configured to receive objects to be dispensed, the chute having an outlet;

a plurality of staging members, each of the staging members being suspended from and pivotally interconnected with the chute, the staging members being coupled to move together between a staging position, in which lower ends of the staging members are drawn together to form an impassable cone, and a dispensing position, in which the lower ends of the staging members radially withdraw from each other to permit passage of objects therethrough; and a plurality of contact members, each of the contact members having an upper end that is suspended from and pivotally interconnected with a respective lower end of a staging member, wherein in the staging position, the upper ends of the contact members define a circle having a first circumference, and in the dispensing position, the upper ends of the contact members define a circle having a second circumference that is greater than the first circumference;

wherein contact from underneath forces the contact members to move from the staging position toward the dispensing position.

2. The dispensing chute defined in claim 1, wherein the staging members are biased toward the staging position.

3. The dispensing chute defined in claim 2, wherein the staging members are biased via a spring-loaded mechanism.

4. The dispensing chute defined in claim 2, wherein the staging members are biased toward the staging position by gravity.

5. The dispensing chute defined in claim 1, wherein each of the staging members includes a panel and an overleaf, wherein, when the panels are in the staging position, the panels of the staging members form the impassable cone and each of the overleaves underlies an adjacent panel, such that movement of a panel toward the dispensing position also forces the overleaf of an adjacent panel toward the dispensing position.

6. The dispensing chute defined in claim 5, wherein the panels are generally triangular in shape.

7. The dispensing chute defined in claim 5, wherein each of the overleaves has generally a rounded triangular shape.

8. The dispensing chute defined in claim 1, wherein the plurality of staging members comprises six staging members.

9. The dispensing chute defined in claim 1, wherein the chute comprises upper and lower ends, and wherein the lower end is movable relative to the upper end, such that movement of the staging members toward the dispensing position causes the lower end of the chute to move toward the upper end of the chute.

10. A passive chute assembly, comprising:

a chute configured to receive objects to be dispensed, the chute having an outlet;

a passive dispensing unit attached to the chute outlet, the passive dispensing unit having a staging portion, wherein objects are captured prior to dispensing, the staging portion being movable between a staging position, in which objects may be captured within the staging portion, and a dispensing position, in which the objects may be fed gravimetrically into a receptacle positioned below the dispensing unit;

the staging portion including an adaptive opening that, when the staging portion moves to the dispensing position, opens adaptively corresponding to a diameter of the receptacle.

11. The passive chute assembly defined in claim 10, wherein the adaptive opening is formed in a flexible spout.

12. The passive chute assembly defined in claim 10, wherein the staging portion comprises a plurality of staging members, each of the staging members being suspended from and pivotally interconnected with the chute, the staging members being coupled to move together between the staging position, in which lower ends of the staging members are drawn together to form an impassable cone, and the dispensing position, in which the lower ends of the staging members radially withdraw from each other to permit passage of objects therethrough, the adaptive opening being formed by the lower ends of the staging members.

* * * * *